US006089911A

United States Patent [19]

Goto et al.

[11] Patent Number: 6,089,911

[45] Date of Patent: Jul. 18, 2000

[54] APPARATUS AND METHOD FOR MOUNTING A PLURALITY OF SURFACE MOUNT CONTACTS

[75] Inventors: Kazuhiro Goto, Markham; Steven Keith Woods, Beaverlodge, both of Canada

[73] Assignee: The Whitaker Corporation, Wilmington, Del.

[21] Appl. No.: 08/985,670

[22] Filed: Dec. 5, 1997

[51] Int. Cl.[7] ..... H01R 13/73

[52] U.S. Cl. ..... 439/571

[58] Field of Search ..... 439/607, 571, 439/572, 573, 59, 79, 78, 574.5

[56] References Cited

U.S. PATENT DOCUMENTS

| | | | |
|---|---|---|---|
| 4,150,863 | 4/1979 | Krafthefer et al. . | |
| 4,717,218 | 1/1988 | Ratcliff | 439/59 |
| 5,037,309 | 8/1991 | Abe et al. | 439/56 |
| 5,277,596 | 1/1994 | Dixon | 439/79 |
| 5,307,929 | 5/1994 | Seidler . | |
| 5,457,606 | 10/1995 | Young et al. | 361/737 |
| 5,490,786 | 2/1996 | Mosquera | 439/79 |
| 5,644,839 | 7/1997 | Stone | 29/842 |

*Primary Examiner*—Lincoln Donovan
*Assistant Examiner*—Eugene G. Byrd

[57] ABSTRACT

The invention is directed to a contact housing, having a plurality of contacts therein, to mount the contacts onto a daughter board. The housing has a plurality of holes with the contacts mounted therein. The housing has an arm extending therefrom. The arm has saw teeth thereon to engage the daughter board to secure the housing to the daughter board. The housing has an alignment post to be received within an alignment hole on the daughter board to align the housing thereto.

9 Claims, 8 Drawing Sheets

APPARATUS AND METHOD FOR MOUNTING A PLURALITY OF SURFACE MOUNT CONTACTS

FIELD OF THE INVENTION

The invention is directed to a housing used to align and mount a plurality of surface mount contacts and the process used thereof.

BACKGROUND OF THE INVENTION

Often, daughter boards are mounted to mother boards to provide additional features on the mother board. This is often accomplished using either an electrical connector mounted on the edge of the daughter board or, alternatively, a series of electrical contacts can be mounted along the edge of the daughter board, to extend beyond the edge of the daughter board, and to provide electrical connection between pads on the daughter board and the mother board. One specific example has a series of contacts which have surface mount tails soldered to contact pads on the daughter board and extending along the edge of the daughter board. The contacts have pins which are received within through holes on the mother board to provide electrical connection between the daughter board and the mother board. Because of the large numbers of contacts that are to be secured to the daughter board, and the tight spacing of these contacts, it is very important to make sure that the contacts are properly aligned with the contact pads and to make sure that they are all properly spaced from each other. Further, it is important to provide an easy way of mounting the contacts to the daughter board.

One method for mounting the contacts on the daughter board is to mount the plurality of contacts on a carrier strip having the appropriate spacing between the contacts. The carrier strip is then held against the daughter board so that the solder tails of the contacts are pressed against the contact pads. The carrier scrip is then held while the solder tails are soldered to the contact pads. The carrier strip can then be removed from the contacts. The carrier strip is typically two thin pieces of plastic which are mounted along either side of the contacts and is easily removed from the contacts.

One problem that is encountered using this method is that there is no convenient way of automatically aligning the contacts in the plastic carrier strip to the contact pads on the daughter board and to provide ease of automatic mounting of the contacts to the daughter board.

What is needed is a apparatus and method for automatically mounting the contact to the edge of the daughter board while providing proper alignment and positioning of all the contacts simultaneously.

SUMMARY OF THE INVENTION

The invention is directed to a contact housing to mount a plurality of contacts onto a daughter board. The housing comprises a housing body having a plurality of contacts mounted therein. The housing has a securing member extending therefrom to secure the housing to the daughter board. The housing has an alignment member to align the contacts with the daughter board.

The invention further comprises a method of securing a plurality of contacts along an edge of a daughter board. The method comprises mounting the plurality of contacts within a housing. The housing has a securing member for securing the housing to the daughter board and an alignment member for aligning the housing with the daughter board. The method next comprises mounting the housing to the daughter board followed by soldering the contacts to contact pads on the daughter board. Finally, the method is completed by removing the housing from the daughter board and the plurality of contacts leaving the contacts secured to the daughter board.

BRIEF DESCRIPTION OF THE DRAWINGS

An embodiment of the present invention will now be described by way of example with reference to the accompanying drawings, in which.

DETAILED DESCRIPTION OF THE INVENTION

Figure 1:
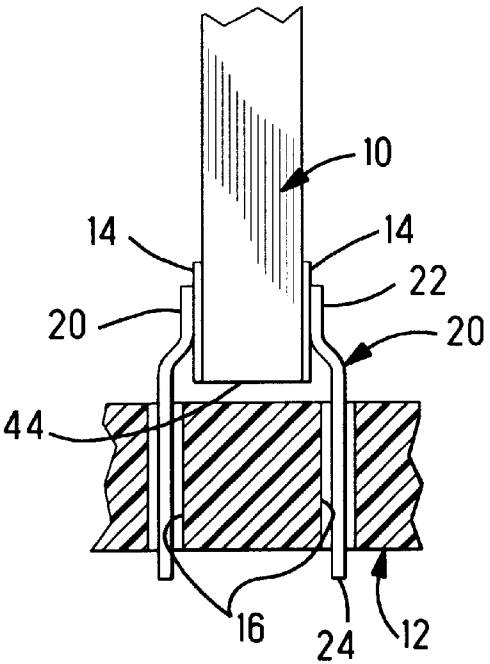
FIG. 1 Prior Art
FIG. 1 is a cross sectional view of a typical daughter board mounted to a mother board.

FIG. 1 shows a cross-sectional view of a typical daughter board 10 mounted to a mother board 12. The daughter board 10 can be any type of circuit board and the mother board is a typical circuit board onto which several components can be mounted. The daughter board 10 is electrically connected to the mother board by a series of contacts 20. The daughter board 10 has a series of contact pads 14 mounted along either side, along the edge of the daughter board. The mother board 12 has a series of through holes 16 which are formed in two rows to receive the contacts 20.

The contact 20 has surface mount tails 22 which are to be received against the contact pads 14. The contacts 20 also have pin portions 24 which are to be received through the through holes 16 to provide electrical connection therein.

Figures 5, 6:
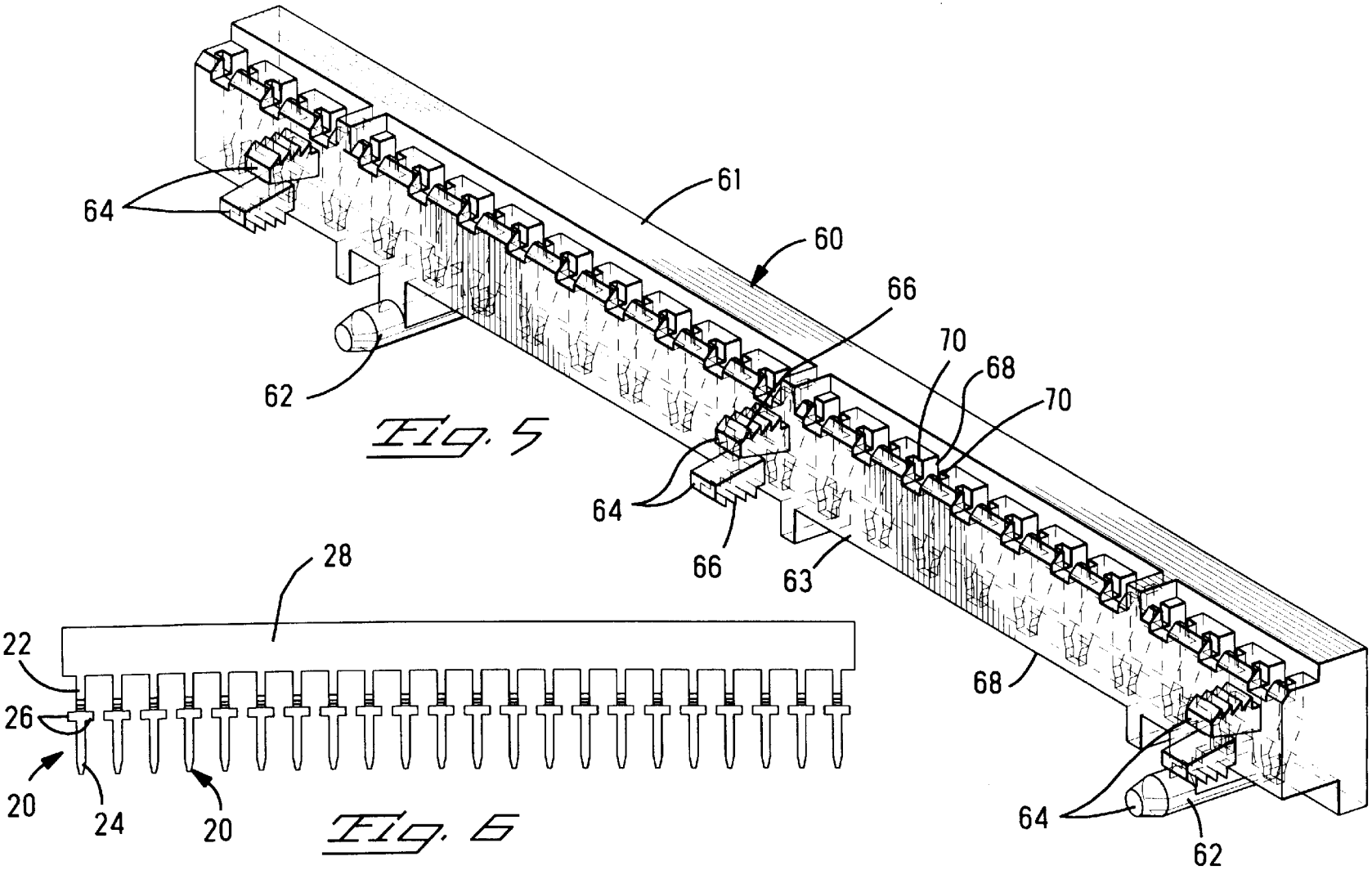
FIG. 5 is an isometric view of the contact housing of the present invention.
FIG. 6 is a side view of the contacts mounted on a carrier strip.

FIG. 6 shows a plurality of contacts 20 prior to being formed in the shape shown in FIG. 1. The contacts 20 are formed along a carrier strip 28. The contacts have tabs 26, which are best shown in FIGS. 2 and 6, which will abut against the upper surface 18 of the mother board 12 when the daughter board is mounted to the mother board, see FIG. 2.

When the daughter boards are produced, they are typically made in series, that is the daughter boards are connected to each other during the formation process so that they can easily be separated after the formation process is complete. The daughter boards 10 are typically formed having a carrier strip 14 extending along either side. Between the adjacent daughter boards, there is formed a slot 40. The slot 40 extends into the carrier strip 42 so that upon completion of the formation of the daughter boards, the carrier strip 42 can be removed along the break line 46 thereby completely separating one daughter board 10 from the other daughter board 10. The slot 40 is formed between the top upper surface 45 of one daughter board 10 and the lower surface 44 of the adjacent daughter board 10. The lower surface 44 is the surface edge 18 that will be received against the mother board 12.

Figure 2:
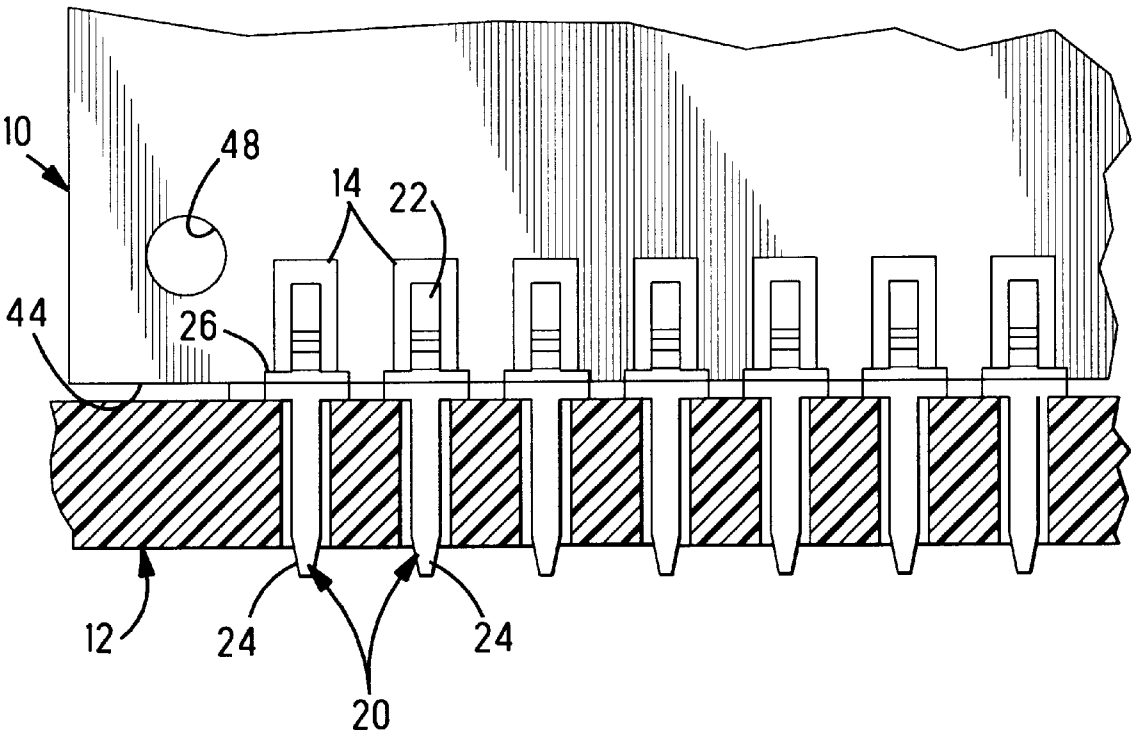
FIG. 2 Prior Art
FIG. 2 is a side view of the daughter board mounted to the mother board.
Figure 3:
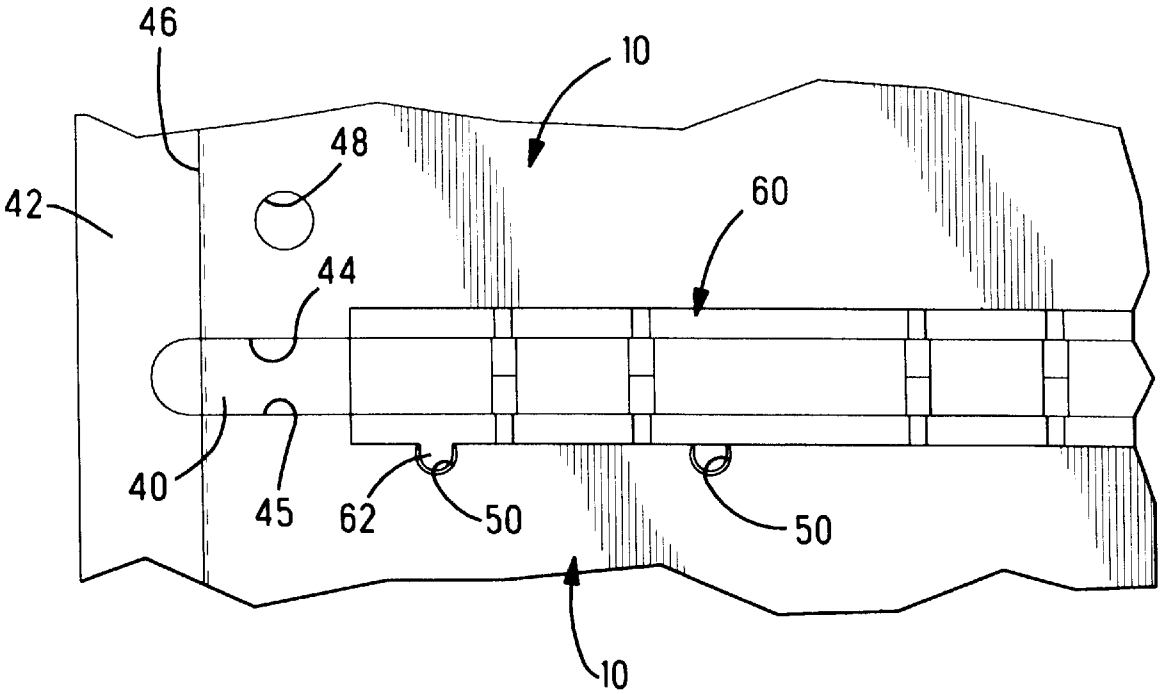
FIG. 3 is a top view of the daughter board as the daughter board is being formed and having the contact housing mounted thereon.

As shown in FIGS. 2 and 3, the upper daughter board 10 has a fixture hole 48 and the lower daughter board 10 has alignment holes 50.

Figure 4:
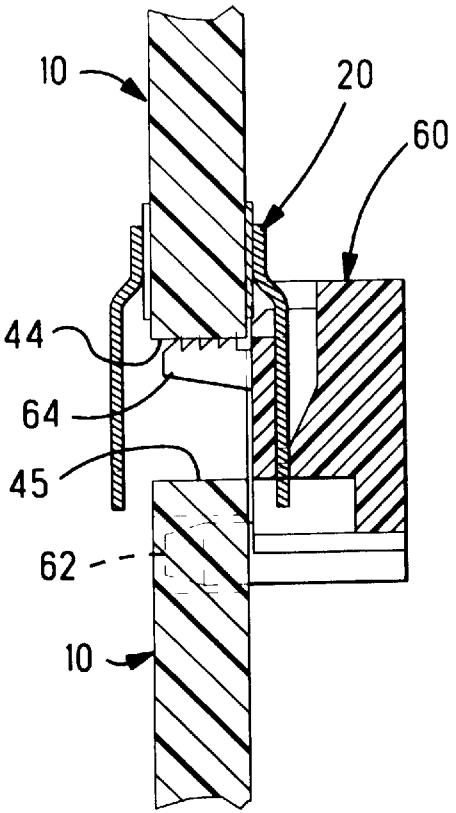
FIG. 4 is a cross sectional view of the daughter board as it is being formed and of the contact housing of the present invention.

The contact housing 60, as shown in FIGS. 4 and 5, will have the contacts 20 fully formed and loaded therein and will be mounted along the slot 40 wherein the alignment posts 62 will be received within the appropriate alignment hole 50 on the lower daughter board. The arms 64 will be received against the edges 44, 45 of the daughter boards, thereby aligning and securing the contacts 20 mounted within the housing 60 up against the contact pads 14 of the daughter board.

FIG. 5 shows a perspective view of the contact housing 60 of the present invention. The housing 60 has a top surface 61 and a front surface 63. The alignment post 62 and the arms 64 extend from the contact housing 60 from the front surface 63. These arms 64 have saw teeth 66 extending along one side thereof. The arms 64 are alternating so that the lower arm is off-set from the upper, proximate arm. The saw teeth 66 are also directed in opposite directions. The saw teeth 66*a* on arm 64*a* are directed upwardly while the saw teeth 66*b* on arm 64*b* are directed downwardly, see FIGS. 7 and 8. When the contact housing 60 is mounted into the slot 40 the saw teeth on 64*a* will engage the edge of the top daughter board 44 and the saw teeth 66*b*, which are directed downwardly on arm 64*b*, will engage the upper surface of the lower daughter board. While the specific embodiment is shown having arms 64 with saw teeth 66 to secure the housing 60 to the boards 10, other securing members could be used to secure the housing 60 to the boards 10.

Figure 9:
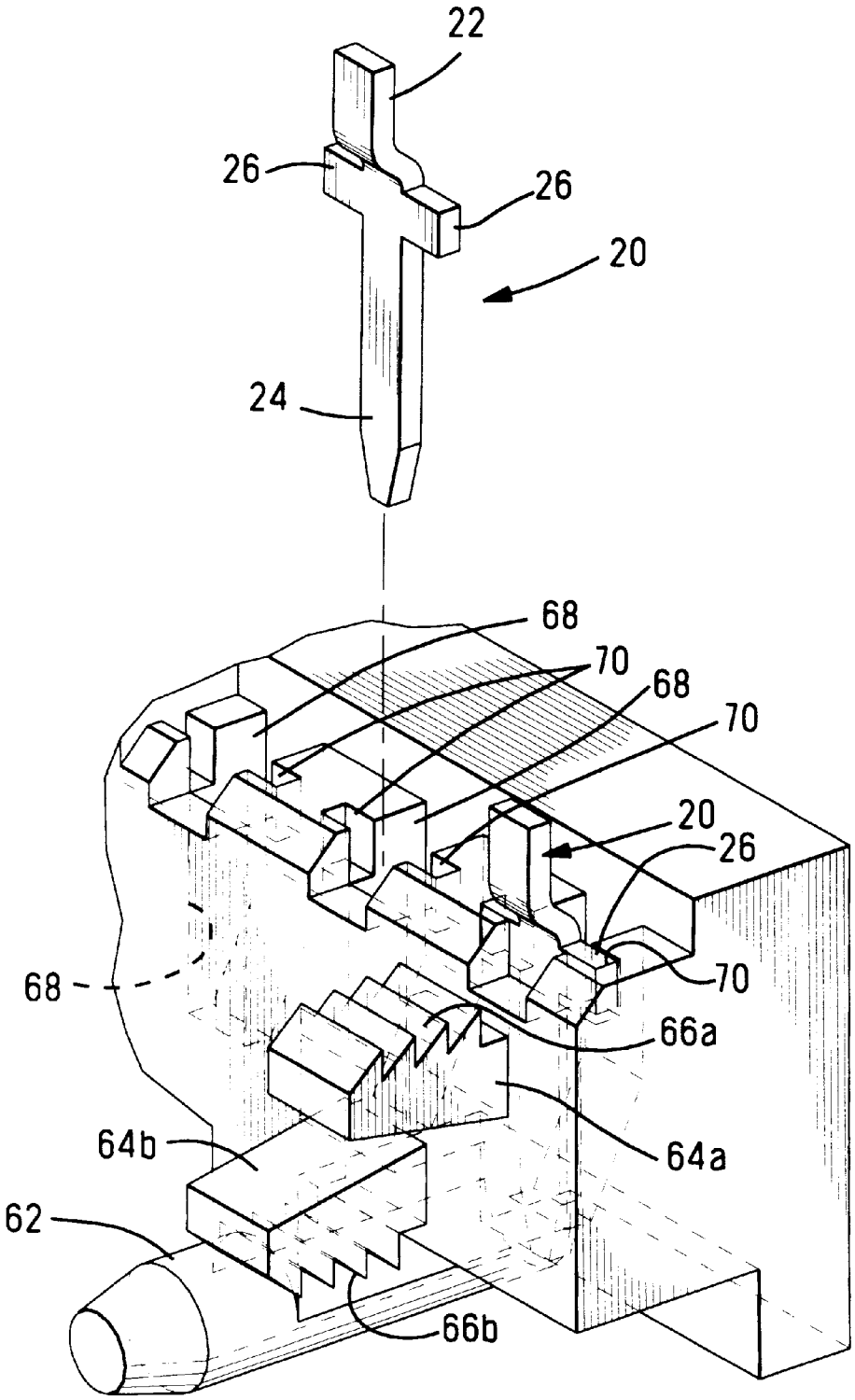
FIG. 9 is a perspective view of the contact housing with the contacts mounted therein.

The contact housing 60 has a plurality of contact receiving holes 68 extending from the top surface 61. Along the top surface 61 the contact receiving holes have tab slots 70. When the contacts 20 are mounted into the contact housing 60 the pins 24 will be received within the contact receiving holes 68, and the tabs 26 will be received within the tab slot 70, see FIG. 9. The contacts 20 can be mounted all at once by keeping them mounted on the carrier strip 28 and mounting them in the contact housing 60 at one time, and then subsequently forming the solder tails. Alternatively, the contacts could first be formed and then mounted within the contact housing or they could be formed and removed from the carrier strip and mounted individually into the contact housing, depending on the specific application needed. The contacts 20 can be secured within the contact housing 60 by either having an interference fit between the pin portion 24 in the contact receiving hole 68 or, alternatively, by having an interference fit between the tabs 26 and the tab slots 70.

Figure 7:
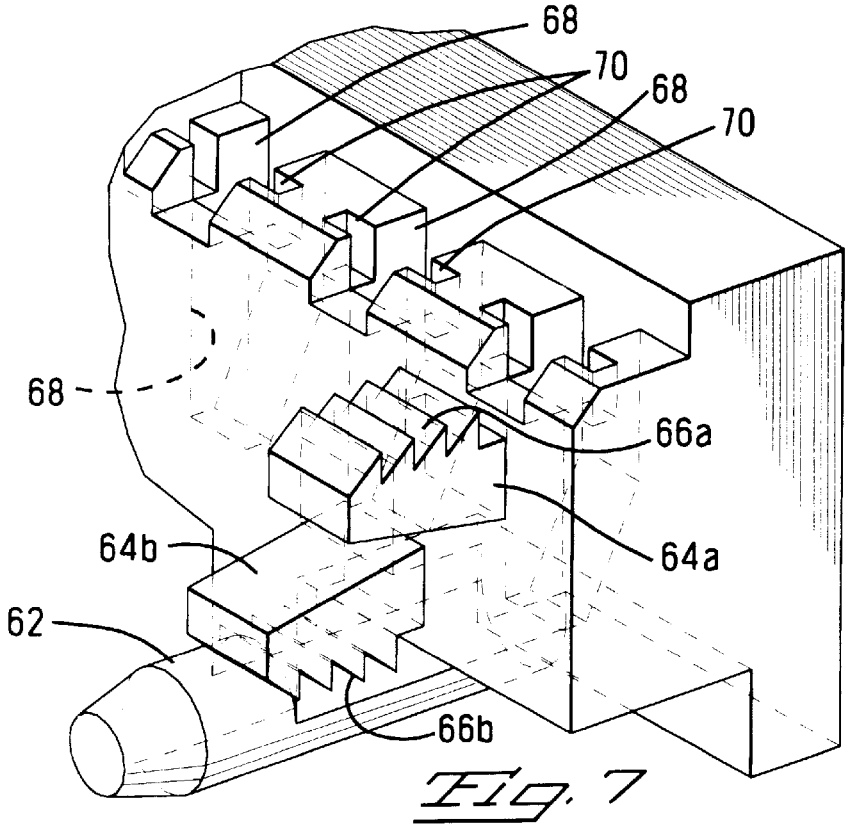
FIG. 7 is a perspective view of the contact housing of the present invention showing the hidden parts of the housing in phantom.
Figure 8:
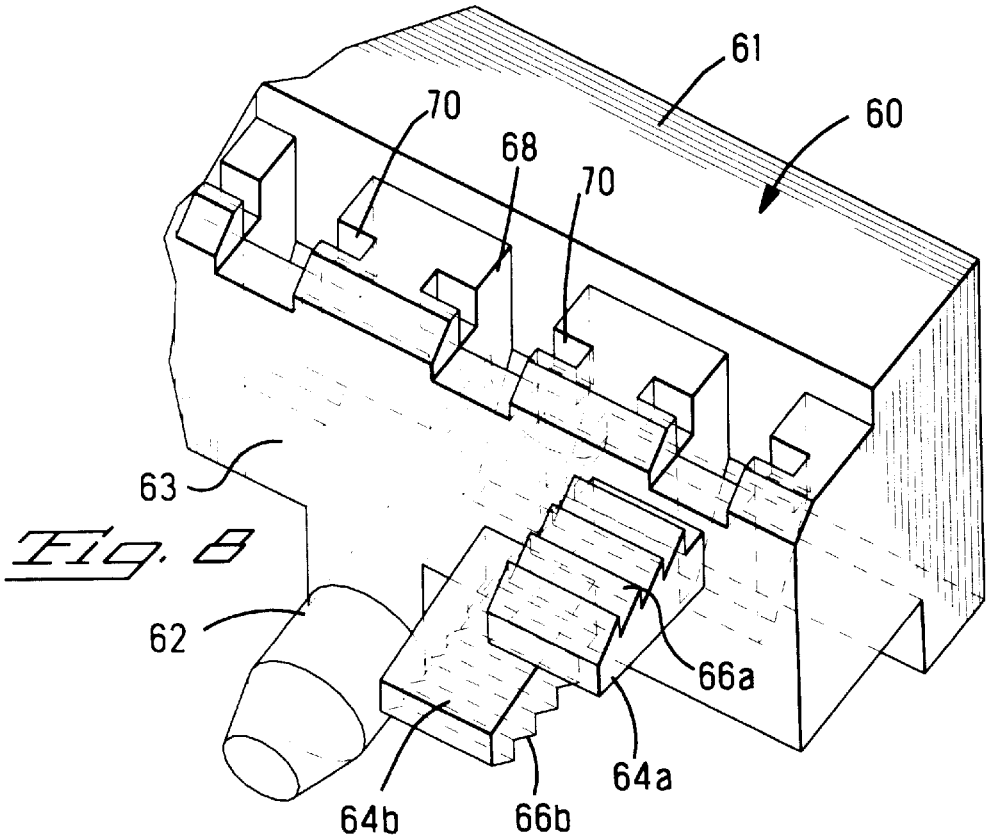
FIG. 8 is a perspective view of the contact housing.

FIG. 7 shows an enlarged view of the contact housing 60, showing more details of the contact receiving hole 68 in phantom. FIG. 8 shows an enlarged view of the contact housing 60, showing that the arms 64 are staggered from each other so that one is not directly on top of the other.

Once the contact housing 60 is loaded with the contacts 20, the contact housing 60 is secured to the daughter boards by aligning the alignment post 62 with the aligning hole 50. The contact housing is then pushed up against the daughter boards 10 and the arms 64 are received within slot 40 along the adjacent edges 44, 45 of the adjacent daughter boards 10,10. The solder tails 22 are received up against the contacts pads 14 so that they can be soldered thereto while they are aligned to the daughter boards. Once the solder tails 22 on the one side are secured and soldered, the contacts 20 can then be secured to the other side while the first contact housing 60 is still mounted thereon. Another housing 60, having a second group of contacts 20 mounted therein, is pushed against the opposite side of the daughter boards 10. The alignment posts 62 are offset from the ends of the contact housing 60 to a different extent so that the alignment posts use different aligning holes when they are mounted on opposite sides of the daughter board. Further, because the arms 64 are offset from each other they do not interfere with arms 64 on another housing 60 which is mounted on the opposite side of the boards 10, 10, thereby allowing two housings 60 to be mounted on opposite sides of the board 10 simultaneously.

Once the contacts 20 are mounted on both sides of the daughter board, it is possible for the carrier strip 42 to be removed from the daughter boards along the breaking line 46 thereby separating the daughter boards 10. Further, fixture hole 48 can receive a tool which will automatically push the housing 60 off of the pins 24 of the contacts 20 thereby leaving the daughter board 10 free with the contacts 20 extending from the one edge so that the daughter board can be mounted to the mother board 12.

Figure 10:
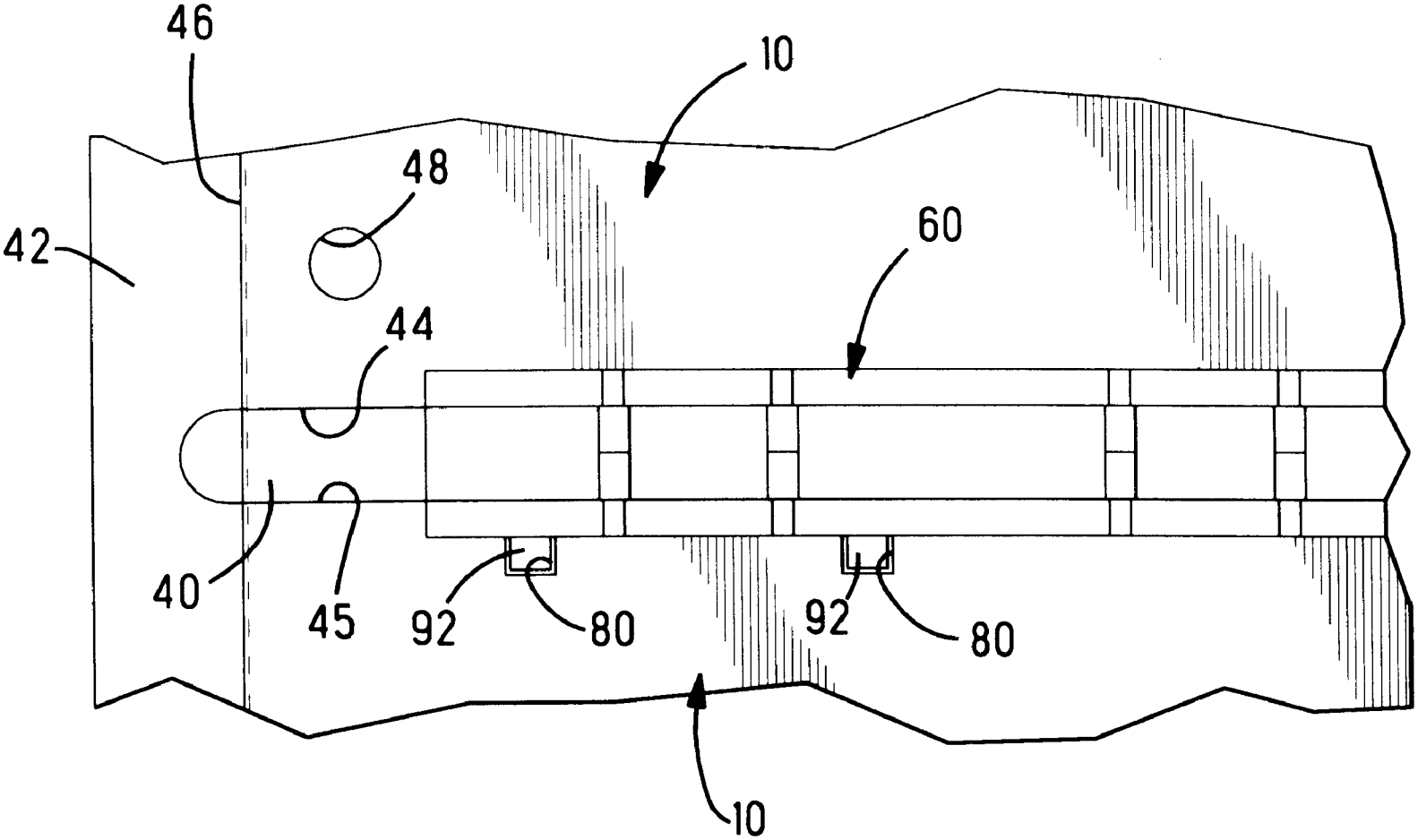
FIG. 10 is a top view of the daughter board as the daughter board is being formed and having an alternative embodiment of the contact housing mounted thereon.
Figure 11:
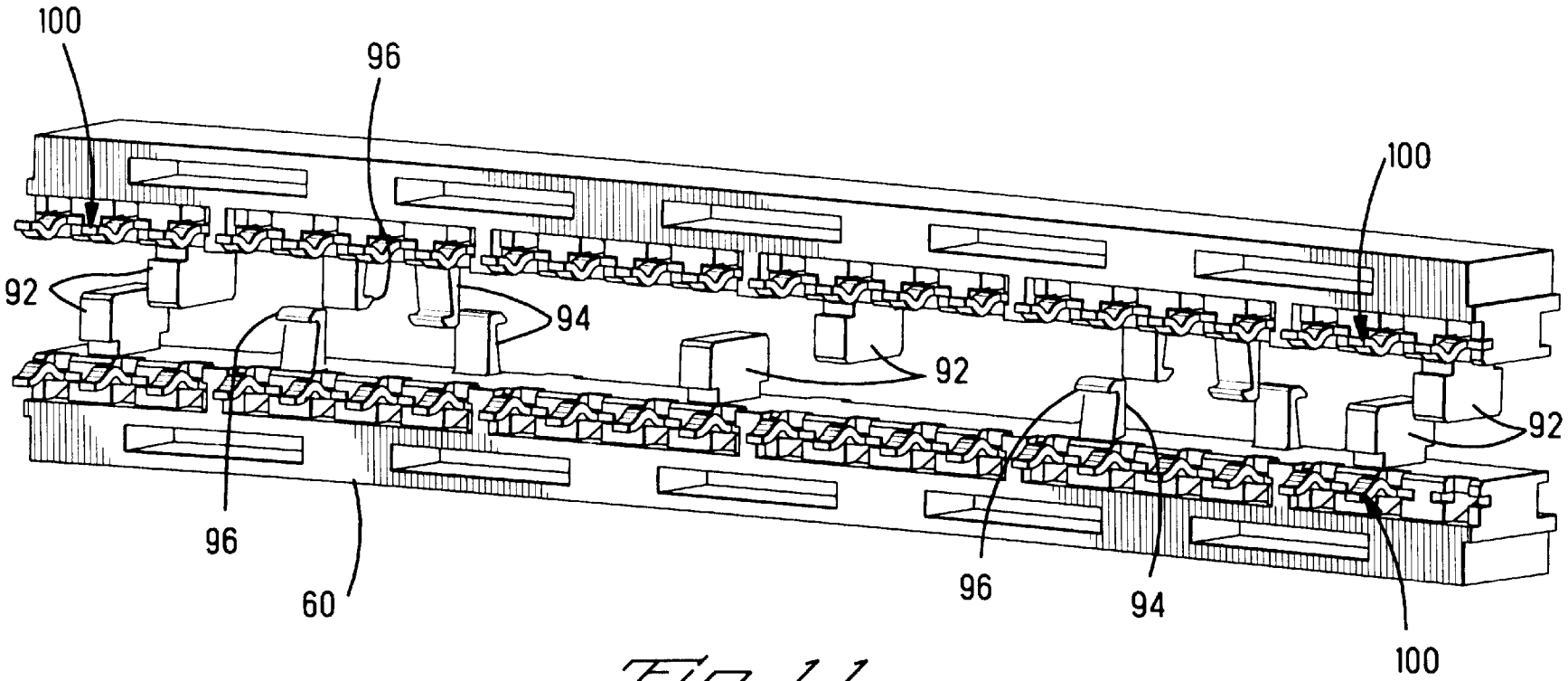
FIG. 11 is an isometric view of the contact housing having the alternative embodiment.
Figure 12:
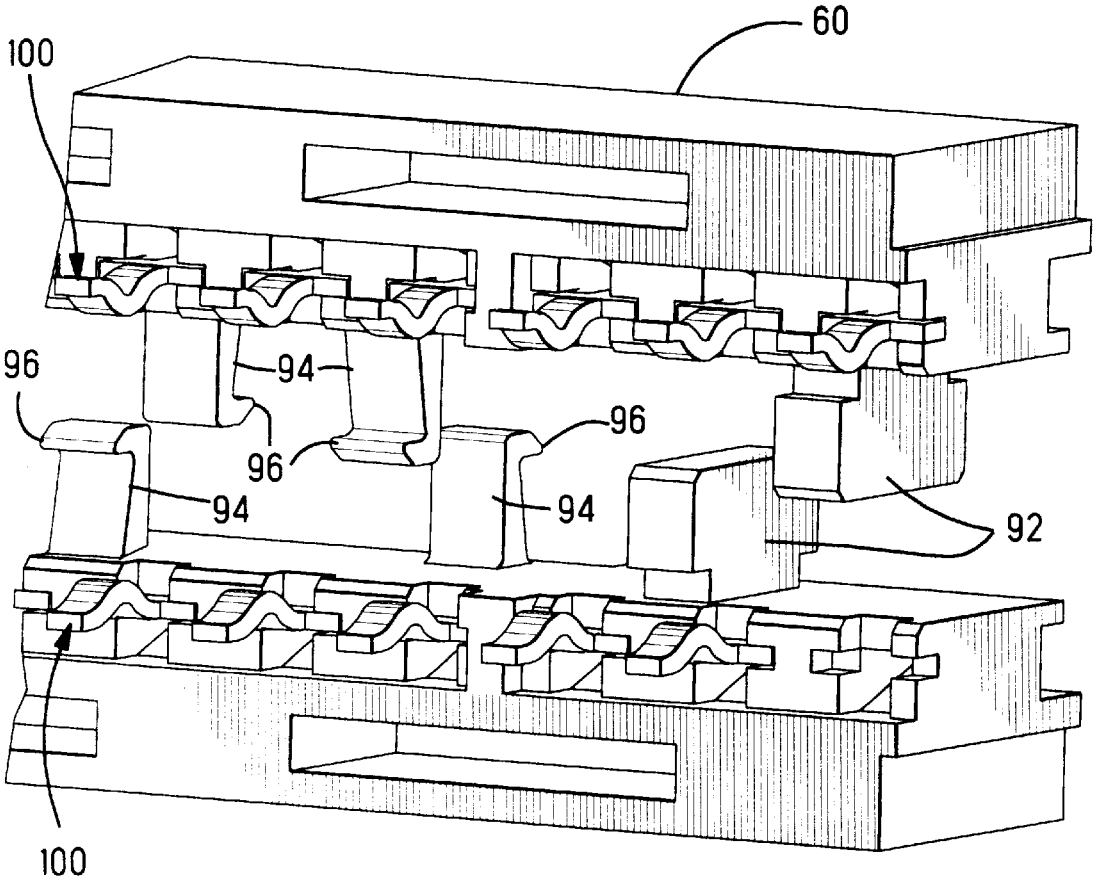
FIG. 12 is a perspective view of the alternative embodiment of the contact housing.
Figure 13:
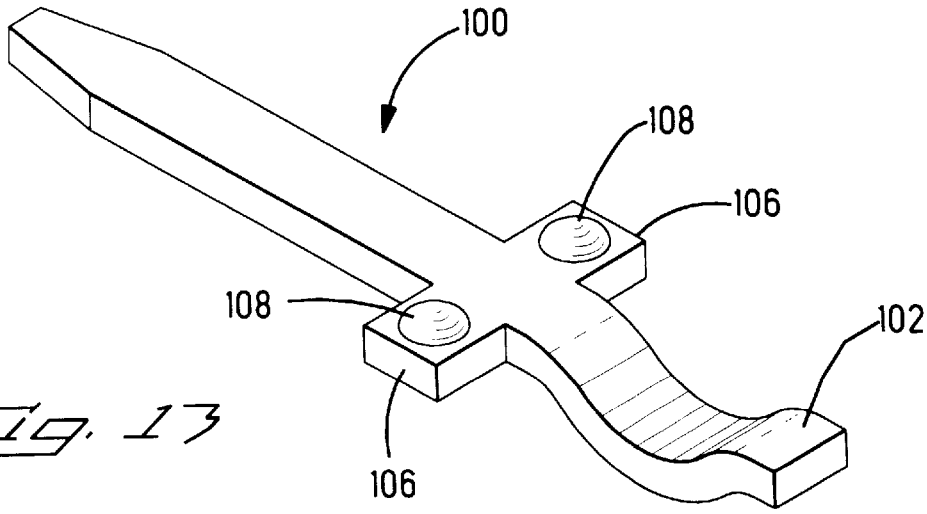
FIG. 13 is a perspective view of an alternative embodiment of the contact.

An alternative embodiment of the present invention is shown in FIGS. 10 through 12 where the alignment holes 50 of FIG. 3 are in the form of grooves 80 and the alignment posts 62 of FIG. 5 are in the form of blocks 92. Arms 64 as shown in FIG. 5 may also be configured as shown in FIG. 11, wherein the arms 94 have one tooth 96 rather than a plurality of saw teeth. The arms 94 are shown in detail in FIG. 12. FIGS. 11 and 12 also illustrate the use of contacts 100, as shown in detail in FIG. 13.

FIG. 1L3 shows the alternative embodiment of a contact 100, wherein the tabs 106 have raised dimples 108 for interferingly retaining the contact within the contact receiving hole. Also, solder tab 102 may be formed in any of a number of shapes.

The contact housing, and the method of mounting the contacts to the daughter board, of the present invention and many of their attended advantages will be understood from the foregoing description. It is apparent that various changes made be made in the form, construction, and arrangement of parts thereof without departing from the spirit and scope of the invention, or sacrificing all of its material advantages.

What is claimed is:

1. A contact housing to mount a plurality of contacts onto a daughter board, the housing comprising:

a housing body having a plurality of contacts mounted therein, the housing having at least two securing members extending therefrom to secure the housing to the daughter board, the housing having an alignment member to align the contacts with the daughter board, each said securing member having an engaging section defining pluralities of teeth.

2. The contact housing of claim 1, wherein the alignment member is a block to be received within an alignment groove.

3. The contact housing of claim 1, wherein the alignment member is a post to be received within an alignment hole.

4. The contact housing of claim 1, wherein each of the plurality of contacts have a contact pin portion and a solder tail portion.

5. The contact housing of claim 4, wherein each of the plurality of contacts have tabs extending therefrom to provide alignment of the plurality of contacts within the housing body.

6. The contact housing of claim 5, wherein the housing body has a plurality of contact receiving cavities therein, the cavities having tab receiving recesses to receive the tabs therein.

7. The contact housing of claim 6, wherein the tabs have raised dimples for interferingly retaining the contacts within the contact receiving cavities.

8. The contact housing of claim 1, wherein the housing has two arms, each of the arms having teeth extending therefrom, the teeth on one of the arms being directed in a different direction from the teeth on the other one of the arms.

9. The contact housing of claim 1, wherein the housing has a first set of arms and a second set of arms, each of the arms having teeth extending therefrom, the teeth on the first set of arms being directed in the opposite direction from the teeth on the second set of arms.

* * * * *